United States Patent [19]

Wiedenmann

[11] 4,114,066

[45] Sep. 12, 1978

[54] SUBMINIATURE INCANDESCENT LAMP

[75] Inventor: Hans Wiedenmann, Heidenheim, Fed. Rep. of Germany

[73] Assignee: Patent-Treuhand-Gesellschaft fur elektrische Gluhlampen m.b.H., Munich, Fed. Rep. of Germany

[21] Appl. No.: 805,368

[22] Filed: Jun. 10, 1977

[30] Foreign Application Priority Data

Jun. 22, 1976 [DE] Fed. Rep. of Germany ... 7619712[U]

[51] Int. Cl.[2] ..... H01K 1/44; H01J 5/48

[52] U.S. Cl. ..... 313/315; 313/318

[58] Field of Search ..... 313/315, 318

[56] References Cited

U.S. PATENT DOCUMENTS

| | | | |
|---|---|---|---|
| 2,937,308 | 5/1960 | Howles et al. | 313/315 |
| 3,979,627 | 9/1976 | Leadvaro et al. | 313/318 |

*Primary Examiner*—Alfred E. Smith
*Assistant Examiner*—Charles F. Roberts
*Attorney, Agent, or Firm*—R. S. Lombard

[57] ABSTRACT

A subminiature incandescent lamp having a tubular bulb with a flattened press portion effecting closure of the bulb having a pair of lead-in wires sealed therethrough. The lead-in wires extend exteriorly of the bulb and are re-entrant into the press portion of the bulb to form two U-shaped loops, the sides of each of which touch throughout their length, and with the loops bent back about opposite sides of the flattened press portion.

1 Claim, 3 Drawing Figures

SUBMINIATURE INCANDESCENT LAMP

BACKGROUND OF THE INVENTION

The improvement relates to a subminiature incandescent lamp, comprising a tubular bulb which is closed at one end by a vitreous stem press. Internally of the bulb, a filament is supported by a pair of lead-in wires which are sealed in a glass bead and are kept by the latter electrically insulated from one another at a predetermined distance. The lead-in wires are sealed in the vitreous stem press and project from the bottom end thereof and are bent such, that one lead-in wire end each closely abuts one of the broadsides of the vitreous stem press. To improve contact making of the lamp within the socket, the lead-in wire ends were previously flattened, whereby the contact area between the lead-in wires and the socket contacts was enlarged. Difficulties with contact making occur, however, frequently due to the fact that the lead-in wires are laterally distorted so that they cannot be touched by the socket contacts.

SUMMARY OF THE INVENTION

The aim of the present improvement is to devise a subminiature incandescent lamp with a flattened press portion, wherein the lead-in wires are designed such, that reliable contact making of the lamp within the socket is ensured.

The subminiature incandescent lamp in accordance with the improvement comprises a tubular bulb wherein a filament is supported by a pair of lead-in wires sealed into a glass bead, and wherein the lead-in wires are sealed in a flattened press portion effecting closure of the bulb. Pursuant to the invention, the outer sections of the lead-in wires are bent to U-shaped loops which are in touch with one another along their overall length, the re-entrant ends being sealed in the vitreous stem press and the loops being bent around the lower end of the vitreous stem press such that one loop at a time closely abuts one of the flattened broadsides of the press portion.

BRIEF DESCRIPTION OF THE DRAWINGS

The subminiature incandescent lamp in accordance with the invention will now be described by way of the accompanying drawings, wherein.

DESCRIPTION OF THE PREFERRED EMBODIMENT

Figure 1:
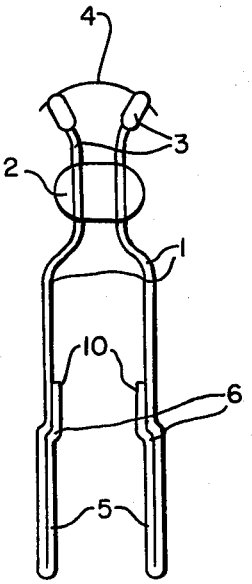
FIG. 1 is a mount for a subminiature incandescent lamp.
Figure 2:
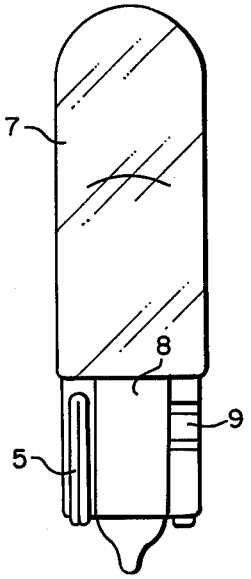
FIG. 2 is a front view of a finished subminiature incandescent lamp.

As is shown in FIG. 1, the mount for the subminiature incandescent lamp in accordance with the invention comprises a pair of lead-in wires 1 which are sealed and spaced at a predetermined distance from one another in a glass bead 2. A filament 4 is affixed and supported between the short ends 3 of the lead-in wires 1. The outer sections of the lead-in wires 1 extend exteriorly of a tubular bulb 7 having a flattened press portion 8 effecting closure of the same. The lead-in wires 1 are sealed through the flattened press portion of the bulb 7. Re-entrant sections 10 of each of the outer lead-in wire sections are supported in the flattened press portion 8 to form two U-shaped loops 5, the sides of each of which touch throughout their length. The outer sections have crimpings 6 externally of the area to be pinch-sealed for engaging the bulb rim. The aforesaid mount is pinch-sealed in the tubular bulb 7 provided with a round bowl such as is to be seen from FIG. 2. The U-shaped loops 5 of the lead-in wires are bent back about the lower end of the flattened press portion 8.

Figure 3:
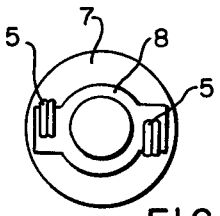
FIG. 3 is a top plan view of the wedge base.

As shown in FIG. 3, the loops 5 of the lead-in wires 1 outer sections are bent such that each loop 5 closely abuts opposite sides of the flattened press portion 8. The closely abutting U-shaped loops 5 of the lead-in wires 1 are mechanically stable so that they cannot be distorted laterally and thus permit an efficient contact making of the lamp within a socket. Moreover, the contact area between the lead-in wires of the lamp and the socket contact is enlarged due to the side-by-side arrangement of the two lead-in wires. The flattened press portion 8 is provided as usual with grooves 9 for mechanical support of the lamp internally of a socket.

What is claimed is:

1. In combination with a subminiature lamp comprising a tubular bulb, a pair of lead-in wires spaced within said bulb by a glass bead in which said lead-in wires are sealed, and a filament supported within said bulb by said lead-in wires, a flattened press portion of said bulb effecting closure of same, and said lead-in wires sealed through said flattened press portion of said bulb, the improvement which comprises:

outer sections of said lead-in wires extending exteriorly of said bulb, re-entrant sections of each of said outer lead-in wire sections being supported in said flattened press portion to form two U-shaped loops the sides of each of which touch throughout their length, and said U-shaped loops each bent back about the lower end of said flattened press portion with said loops closely abutting opposite sides of said flattened press portion.

* * * * *